US006134939A

United States Patent [19]

Sofy

[11] Patent Number: 6,134,939

[45] Date of Patent: Oct. 24, 2000

[54] TOOLLESS QUICK RELEASE OF TRANSFER BAR

[75] Inventor: Hugh M. Sofy, Troy, Mich.

[73] Assignee: HMS Products, Troy, Mich.

[21] Appl. No.: 09/347,199

[22] Filed: Jul. 2, 1999

[51] Int. Cl.[7] ..... B21D 43/05

[52] U.S. Cl. ..... 72/405.16; 72/405.13; 72/405.01; 198/621.1

[58] Field of Search ..... 72/405.01, 405.09, 72/405.13, 405.16, 405.11; 198/621.1; 403/263, 252, 247, 321, 379.5, 378, DIG. 4

[56] References Cited

U.S. PATENT DOCUMENTS

| | | | |
|---|---|---|---|
| Re. 34,581 | 4/1994 | Sofy | 72/405.16 |
| 2,687,268 | 8/1954 | Hawes . | |
| 3,180,663 | 4/1965 | Lehmann . | |
| 3,863,486 | 2/1975 | Lassy | 72/405 |
| 4,139,089 | 2/1979 | Jensen | 198/621 |
| 4,511,029 | 4/1985 | Okawa | 198/621 |
| 4,586,364 | 5/1986 | Berger | 72/405 |
| 4,753,103 | 6/1988 | Braun | 72/405 |
| 4,873,860 | 10/1989 | Werner | 72/405.01 |
| 4,924,692 | 5/1990 | Rieger et al. | 72/405 |
| 4,932,235 | 6/1990 | Rieger et al. | 72/405 |
| 5,121,623 | 6/1992 | Brzezniak | 72/405 |
| 5,131,256 | 7/1992 | Sofy | 72/405 |
| 5,257,889 | 11/1993 | Asakura et al. | 414/752 |
| 5,581,868 | 12/1996 | Bisch | 403/263 |
| 5,680,787 | 10/1997 | Fisch | 72/405.16 |
| 5,782,129 | 7/1998 | Vanderzee et al. | 72/405.1 |
| 5,899,109 | 5/1999 | Fisch | 72/405.16 |

FOREIGN PATENT DOCUMENTS

| | | | |
|---|---|---|---|
| 116834 | 6/1989 | Japan | 72/405.16 |

*Primary Examiner*—Daniel C. Crane
*Attorney, Agent, or Firm*—Howard & Howard

[57] ABSTRACT

A workpiece transfer assembly (10) for a press includes a reciprocating member and a series of longitudinally spaced in-line stations wherein each station is a further progression of the workpiece (W) forming process. The assembly (10) includes a shaft (14) having a distal end (34) for supporting the transfer bar (12). The distal end (34) of the shaft (14) has a bore (35) for receiving a pin (36) which also extends through the transfer bar (12) for securing the transfer bar (12) to the shaft (14) in a locking position. A spring (52) interconnects the end of the shaft (14) and the pin for retaining.

11 Claims, 3 Drawing Sheets

TOOLLESS QUICK RELEASE OF TRANSFER BAR

BACKGROUND OF THE INVENTION

1) Technical Field

This invention relates generally to transfer assemblies having a transfer bar for transferring workpieces through a machine such as a press. More particularly, the invention relates to an assembly for mounting the transfer bar.

2) Description of the Prior Art

Workpiece transfer assemblies are commonly used for moving workpieces through a machine performing a series of operations on the workpieces such as, for example a progressive die operation in a press. The assembly includes a transfer bar having fingers aligned with each die station for clasping and moving the workpieces to subsequent stations furthering the work progression. The transfer bar is moved by an arm assembly.

Each die configuration produces distinct workpieces requiring matching fingers on the transfer bar for clasping and moving the workpieces. Thus, the transfer bar must be changed for operating with a given die. Currently transfer bars are fastened to the arm by a screws longitudinally oriented with the arm or some other method requiring tools for manipulation. Replacing transfer bars having these types of fastening systems is time consuming adding to the die downtime during die changes.

SUMMARY OF THE INVENTION AND ADVANTAGES

A workpiece transfer assembly for a press includes a reciprocating member and a series of longitudinally spaced in-line stations wherein each station is a further progression of the workpiece forming process. The assembly includes a transfer bar and motion transmitting means for moving the bar in and out and longitudinally for transferring work pieces through the press. The motion transmitting means includes a shaft having a distal end for supporting the transfer bar. The distal end of the shaft has a bore extending transversely therethrough, and a pin extends through the transfer bar and the bore in the shaft for securing the transfer bar to the shaft in a locking position.

The subject invention provides an effective connection between the transfer bar and the shaft which is secure and can be changed in short order.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
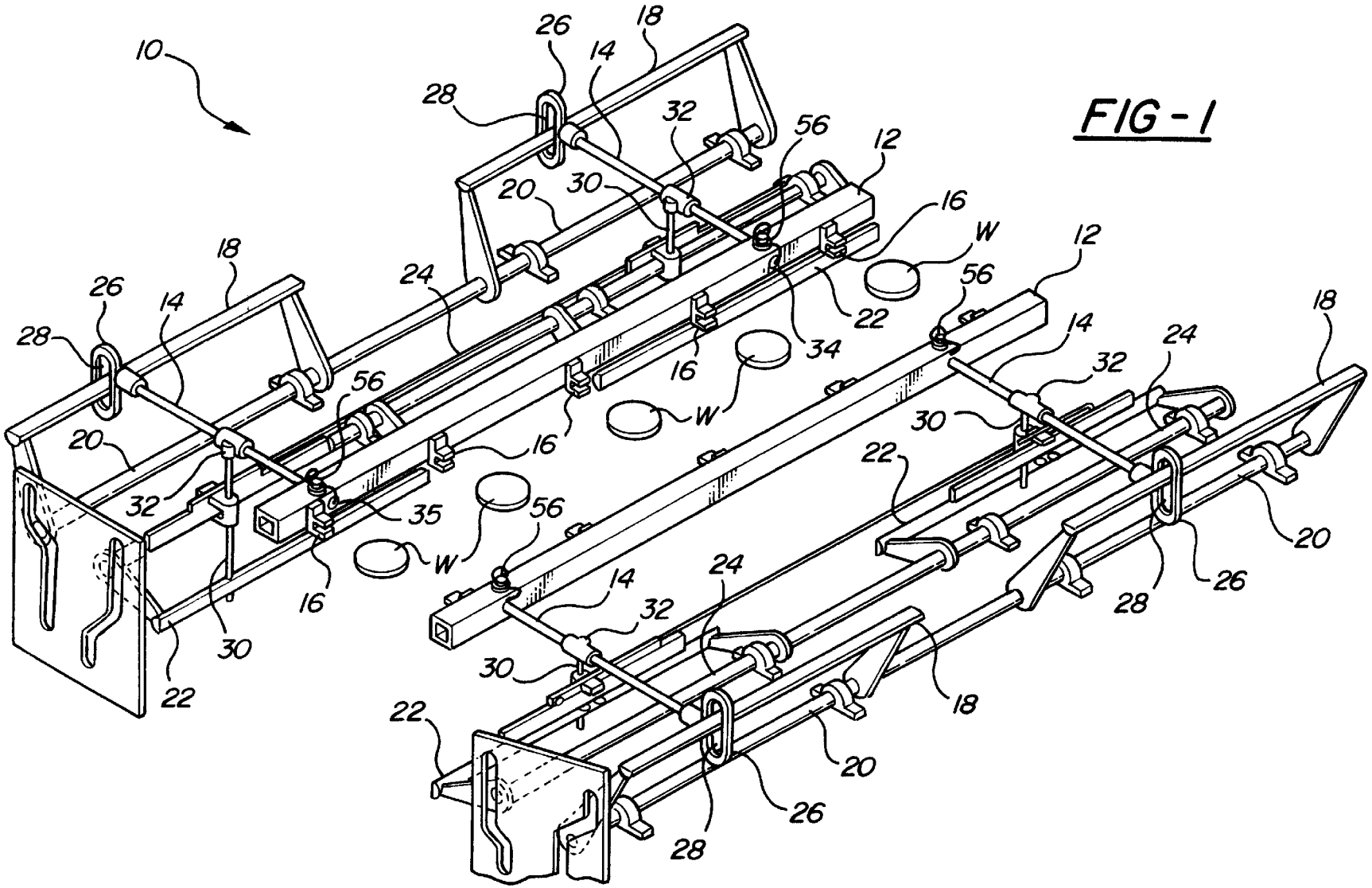
FIG. 1 is perspective view of a punch press transfer mechanism incorporating the subject invention.

Referring to the Figures, wherein like numerals indicate like or corresponding parts throughout the several views, a workpiece W transfer assembly for a press is generally shown at 10 and includes a reciprocating member and a series of longitudinally spaced in-line stations wherein each station is a further progression of the workpiece W forming process. The transfer assembly is specifically adapted for operation with a press of the type including a reciprocating member, i.e., ram, and a series of in-line die stations wherein each station is a further progression of the workpiece W forming process. For convenience, a plurality of workpieces W are shown in FIG. 1.

The assembly includes a transfer bar 12 and motion transmitting means for moving the bar 12 in and out and longitudinally for transferring work pieces W through the press. The motion transmitting means includes the shafts 14, each having a distal end for supporting the transfer bar 12. For example, the transfer bar 12 includes a plurality of fingers 16, each aligned with a work station. The fingers 16 are configured to grasp workpieces W for moving the workpieces W along longitudinal positions during the forming process. Alternate finger 16 configurations are required to grasp various shapes of workpieces W formed from different forming processes. Thus a workpiece W transfer assembly includes a variety of transfer bars 12, each having an alternate finger 16 configuration corresponding to a particular workpiece W shape. In other words, the transfer bars 12 are changed for processing different parts, i.e., workpieces W.

The motion transmitting means includes a first crank bar 18 driven to oscillate about a first rock shaft 20 by a press ram. A second crank bar 22 is driven to oscillate about a second rock shaft 24 by the press ram. The shaft 14 includes a plate 26 having an elongated slot 28 and is positioned at the opposite end of the shaft 14 from the transfer bar 12. The first crank bar 18 extends through the elongated slot 28 and thereby transfers horizontal motion to the transfer bar 12 moving the bar 12 into and out of engagement with the workpieces W. A vertical linkage 30 extends downward from the shaft 14 via a linear bearing 32 located between the first crank bar 18 and the transfer bar 12. The linkage 30 engages the second crank bar 22 for transferring vertical motion to the transfer bar 12. Indexing means (not shown) drive the plate 26 longitudinally along the work stations for moving the workpieces W in a longitudinal direction. Other motion transmitting means can also be used.

Figure 2:
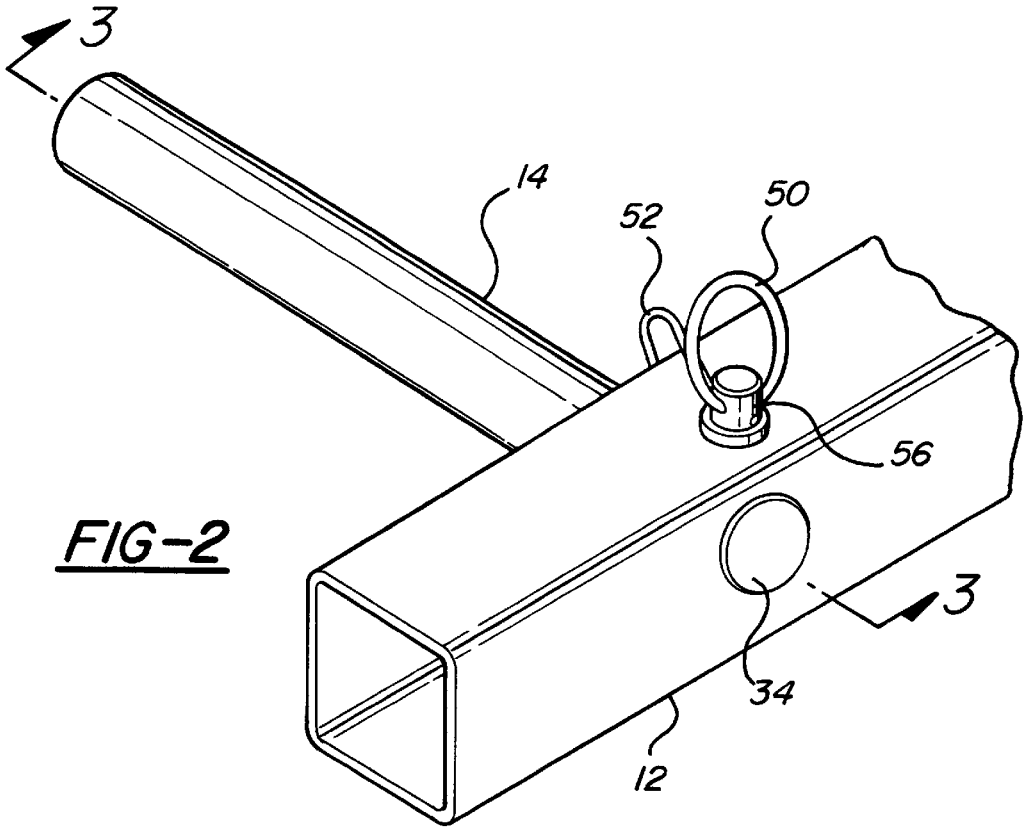
FIG. 2 is a perspective view of the preferred embodiment of the subject invention.
Figure 3:
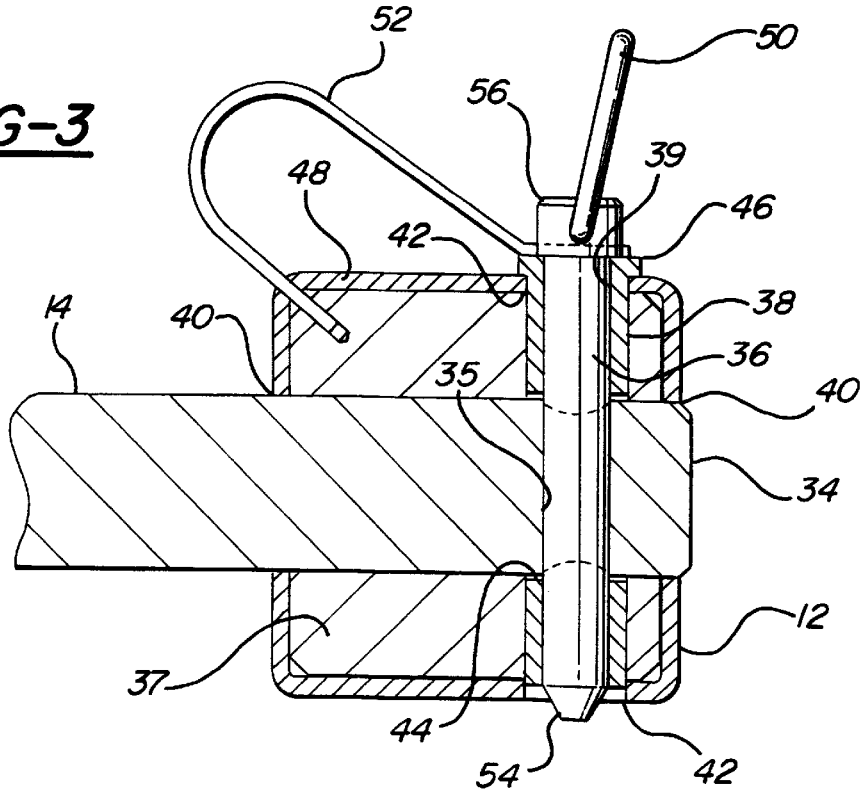
FIG. 3 is a cross sectional view of along line 3—3 of FIG. 2.
Figure 4:
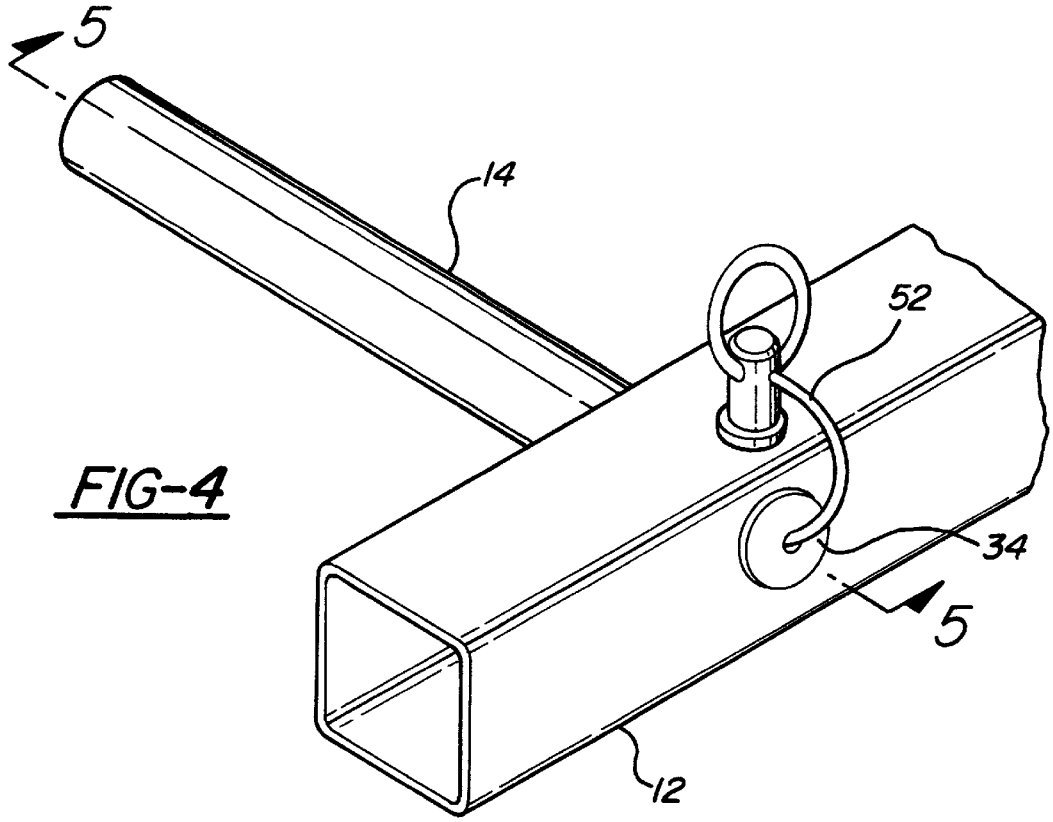
FIG. 4 is a perspective view similar to FIG. 2 showing an alternative embodiment.
Figure 5:
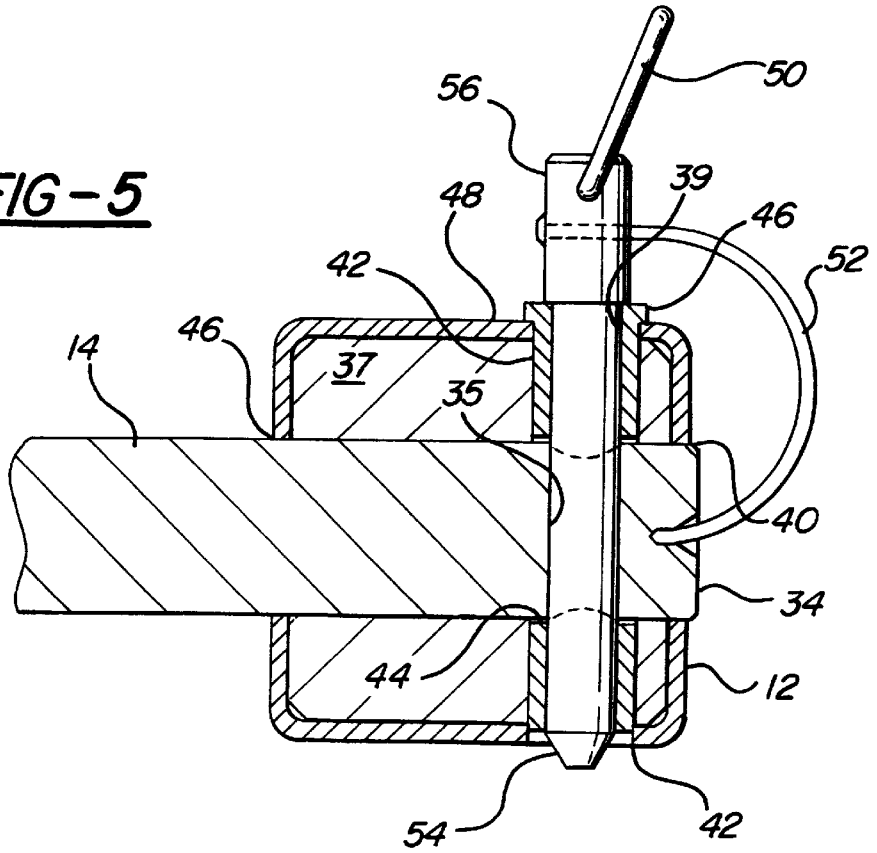
FIG. 5 is a cross sectional view taken along line 5—5 of FIG. 4.

As represented in FIGS. 2 and 3, a distal end 34 of the shaft 14 has a bore 35 extending transversely therethrough. A pin 36 extends through the transfer bar 12 and the bore 35 in the shaft 14 for securing the transfer bar 12 to the shaft 14 in a locking position. The bar 12 has a hollow configuration and includes a collar 38 extending through the bar 12 for receiving the pin 36. A block (37) is disposed within the hollow configuration and the collar (38) extends through the block (37). The transfer bar 12 has horizontal apertures 40 through which the distal end 34 of the shaft 14 extends and vertical apertures 42 through which the collar 38 extends. The collar 38 includes an opening 44 extending transversely therethrough for receiving the shaft 14. Thus, the opening 44 aligns with the horizontal aperture 40 for receiving the distal end 34 of the shaft 14. The collar 38 includes an annular flange 46. The flange 46 has a diameter greater than the vertical aperture 42 and is supported by a horizontal surface 48 of the bar 12.

The pin 36 includes a handle 50 for removing the pin 36 from the collar 38. A spring 52 interconnects the transfer bar 12 and the pin 36 for retaining the pin 36 in the collar 38. In an alternate embodiment, the spring (52) interconnects the shaft (14) and the pin (36) for retaining the pin (36) in the bore (35) in the shaft (14). The pin 36 includes a conical tip 54 for guiding the pin 36 into the collar 38. The pin 36 includes a head 56 having a diameter greater than a diameter of the collar 38 whereby the collar 38 supports the pin 36. The handle 50 facilitates quick removal of the pin 36 from the transfer bar 12 for removing the transfer bar 12 from the assembly. The pin 36 replaces screw in fasteners requiring disassembly tools and reduces assembly downtime during transfer bar 12 replacement.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A workpiece transfer assembly for a press including a reciprocating member and a series of longitudinally spaced in-line stations wherein each station is a further progression of a workpiece forming process, said assembly comprising:

a transfer bar (12)

motion transmitting means for moving said bar (12) inward, outward, and longitudinally for transferring work pieces through the press;

said motion transmitting means including a shaft (14) having a distal end (34) for supporting said transfer bar (12);

said distal end (34) of said shaft (14) having a bore (35) extending transversely therethrough and a pin (36) extending through said transfer bar (12) and said bore (35) in said shaft (14) for securing said transfer bar (12) to said shaft (14) in a locking position, a spring (52) interconnecting said transfer bar (12) and said pin (36) for retaining said pin (36) in said bore (35) in said shaft.

2. A workpiece assembly for a press including a reciprocating member and a series of longitudinally spaced in-line station wherein each station is a further progression of a workpiece forming process, said assembly comprising:

a transfer bar (12);

motion transmitting means for moving said bar (12) inward, outward, and longitudinally for transferring work pieces through the press;

said motion transmitting means including a shaft (14) having a distal end (34) for supporting said transfer bar (12);

said distal end (34) of said shaft (14) having a bore (35) extending transversely therethrough and a pin (36) extending through said transfer bar (12) and said bore (35) in said shaft (14) for securing said transfer bar (12) to said shaft (14) in a locking position;

a spring (52) interconnecting said shaft (14) and said pin (36) for retaining said pin (36) in said bore (35) in said shaft (14).

3. A workpiece transfer assembly for a press including a reciprocating member and a series of longitudinally sapced in-line stations wherein each station is a further progression of a workpiece forming process, said assembly comprising;

a transfer bar (12);

motion transmitting means for moving said bar (12) inward, outward, and longitudinally for transferring work pieces through the press;

said motion transmitting means including a shaft (14) having a distal end (34) for supporting said transfer bar (12);

said distal end (34) of said shaft (14) having a bore (35) extending transversely therethrough and a pin (36) extending through said transfer bar (12) and said bore (35) in said shaft (14) for securing said transfer bar (12) to said shaft (14) in a locking position;

said bar (12) having a substantially hollow configuration and including a collar (38) extending through said bar (12) and having a bore (39) for receiving said pin (36).

4. An assembly as set forth in claim 1 wherein said bar (12) includes a block (37) disposed within said hollow configuration having said collar (38) extending through said block (37).

5. An assembly as set forth in claim 4 wherein said collar (38) includes an opening (44) extending transversely therethrough for receiving said shaft (14).

6. An assembly as set forth in claim 4 wherein said collar (38) includes an annular flange (46) overlying said bar (12).

7. An assembly as set forth in claim 4 wherein said pin (36) includes a handle (50) for removing said pin (36) from said transfer bar (12).

8. An assembly as set forth in claim 5 including a spring (52) interconnecting said transfer bar (12) and said pin (36) for retaining said pin (36) in said collar (38).

9. An assembly as set forth in claim 5 including a spring (52) interconnecting said shaft (14) and said pin (36) for retaining said pin (36) in said bore (35) in said shaft (14).

10. An assembly as set forth in claim 4 wherein said pin (36) includes a conical tip (54) for guiding said pin (36) into said collar (38).

11. An assembly as set forth in claim 5 wherein said pin (36) includes a head (56) having a diameter greater than said bore (39) of said collar (38) whereby said collar (38) supports said pin (36).

* * * * *

UNITED STATES PATENT AND TRADEMARK OFFICE

CERTIFICATE OF CORRECTION

PATENT NO. : 6, 134, 939
DATED : October 24, 2000
INVENTOR(S) : Hugh M. Sofy

It is certified that error appears in the above-identified patent and that said Letters Patent is hereby corrected as shown below:

Claim 3,
Line 9, please delete "sapced" and insert --spaced--.

Claim 4,
Line 29, please delete "Claim 1" and insert --Claim 3--.

Claim 8,
Line 41, please delete "Claim 5" and insert --Claim 4--.

Claim 11,
Line 50, please delete "Claim 5" and insert --Claim 10--.

Signed and Sealed this

Nineteenth Day of June, 2001

*Attest:*

Nicholas P. Godici

*Attesting Officer*

NICHOLAS P. GODICI
*Acting Director of the United States Patent and Trademark Office*